US005168988A

United States Patent [19]

Johnnston

[11] Patent Number: 5,168,988

[45] Date of Patent: Dec. 8, 1992

[54] SCENE AND VERSE COORDINATED COIN AND CARD PACKAGED IN A SINGLE ENTRY TWO SECTION INTERCONNECTED TRANSPARENT PACKAGE

[76] Inventor: C. Lamar Johnnston, 3641 Stratford, Dallas, Tex. 75205

[21] Appl. No.: 432,627

[22] Filed: Nov. 6, 1989

Related U.S. Application Data

[63] Continuation-in-part of Ser. No. 238,770, Aug. 31, 1988, Pat. No. 4,878,580.

[51] Int. Cl.[5] ..... B65D 85/58; B65D 77/00

[52] U.S. Cl. ..... 206/0.81; 206/0.84; 206/45.34; 206/232

[58] Field of Search ..... 206/216, 232, 45.31, 206/45.34, 0.81, 0.82, 0.83, 0.84, 0.8, 471, 467, 468, 461, 469, 470

[56] References Cited

U.S. PATENT DOCUMENTS

| | | | |
|---|---|---|---|
| 4,000,580 | 1/1977 | Biehl | 206/471 X |
| 4,155,454 | 5/1979 | Ryden | 206/461 X |
| 4,187,703 | 2/1980 | Ippoliti et al. | 206/468 X |
| 4,854,450 | 8/1989 | Fisher | 206/461 X |
| 4,878,579 | 11/1989 | Hager | 206/0.84 |
| 4,878,580 | 11/1989 | Johnston | 206/216 |
| 5,009,894 | 4/1991 | Hsiao | 206/470 X |
| 5,042,650 | 8/1991 | Mayer et al. | 206/0.84 |
| 5,046,616 | 9/1991 | Makowski et al. | 206/467 |
| 5,067,611 | 11/1991 | Hagmann et al. | 206/471 X |

*Primary Examiner*—Paul T. Sewell
*Assistant Examiner*—Jacob K. Ackun, Jr.
*Attorney, Agent, or Firm*—Warren H. Kintzinger

[57] ABSTRACT

Greetings along with a portrayal scene are duplicated on both a greeting card and a coin (medallion) packaged together in respective sections of a two section transparent plastic package. The package has a single opening at the top, an elongate rectangular card receiving pocket section at the top and a smaller lower pocket section at the bottom receiving the coin. The pocket sections are separated one from the other by opposite side transverse inwardly directed front and back plastic weld extensions that extend inwardly enough to provide a bottom for the the card receiving pocket section and yet leave enough opening for passage of the coin to and from the lower pocket section. The card, a folded over on itself card, may be removed to be signed personally and reinserted.

3 Claims, 2 Drawing Sheets

SCENE AND VERSE COORDINATED COIN AND CARD PACKAGED IN A SINGLE ENTRY TWO SECTION INTERCONNECTED TRANSPARENT PACKAGE

This is a continuation-in-part of my co-pending application Ser. No. 07/238,770 filed Aug. 31, 1988, now U.S. Pat. No. 4,878,580.

BACKGROUND OF THE INVENTION

This invention relates in general to inspirational, valentines and general greeting cards and mementos, and more particularly, to scene and verse coordinated coins and cards packaged by matched pairs together in a two pocket section transparent protective material package.

Gifts such as greeting cards and mementos have assumed many shapes and forms and have been packaged in many ways. Many of these in the past have required large space consuming racks, trays, drawers and bins and when given as a gift still present storage problems for the recipient who while pleased with being given a large card or large memento faces the problem of storage. Another consideration is that of ease and convenience of shopping for cards and mementos where properly packaged and presented cards and mementos helps make selection both quicker and easier.

It is therefore a principal object of this invention to provide a common theme gift and coin pair in a common package.

Another object with such a gift product is to make selection and purchase easier and more convenient.

A further object is to provide a common theme gift card and coin packaged together that requires minimal space in the store with displays and storage easy to use and stock.

Still another object is to provide such a gift product that has great appeal to the buying public with the thoughtful conveyance bringing happiness to the receiver.

SUMMARY OF THE INVENTION

Features of the invention useful in accomplishing the above objects include, in a scene and verse coordinated common theme gift card and coin packaged together in a two section pocketed single entry transparent protective plastic package, whereby matched pairs of greeting cards and coins, greetings along with a portrayal scene duplicated on both the greeting card and the coin of a pair and with the pair packaged together in respective section pockets of a two section pocketed single entry transparent plastic package. A single top opening is provided for the two section pockets whereby the coin can be removed through the card section pocket and the card, a folded over on itself card, may be removed for being personally signed and reinserted. Each of the paired card and coin packages is provided with a top tab with an opening for convenience mounting on arms of a display rack.

A specific embodiment representing what is presently regarded as the best mode of carrying out the invention is illustrated in the accompanying drawing.

DESCRIPTION OF THE PREFERRED EMBODIMENT

Figure 1:
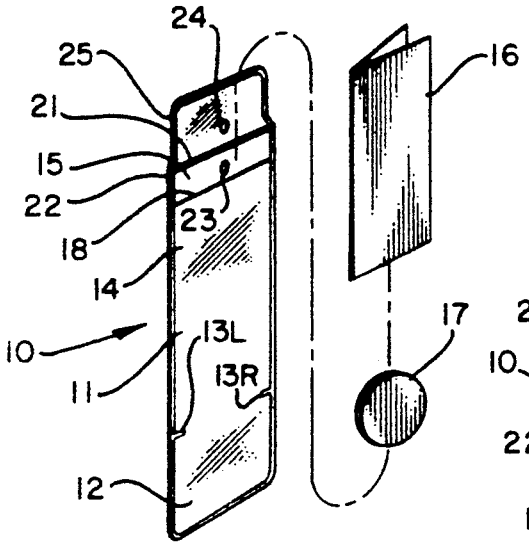
FIG. 1 represents a perspective view of the single entry transparent package with two pocket sections with both the common theme card and coin carried thereby removed from their carrying pockets.

The two section pocketed transparent plastic package 10 of FIGS. 1–5 is shown to have a rectangular elongate larger pocket section 11 at the top and immediately therebelow a smaller pocket section 12. The pocket sections are separated one from the other by opposite side transverse inwardly directed, from opposite left and right side edges, weld extensions 13L and 13R that are lengths of plastic weldment between the front 14 and the back 15 of the plastic package 10. The rectangular elongate larger pocket 11 at the top is sized and shaped to contain a folded over on itself card 16 that is limited from downward movement by left and right side weld extensions 13L and 13R. The smaller pocket section 12 is sized and shaped to receive and contain a coin 17 that is passable through the space between the inner ends of left and right side weld extensions 13L and 13R. A single top opening 18 is provided for the two section pockets 11 and 12 at the top of section pocket 11 whereby the coin 17 can be removed through the card 16 section pocket 11. The folded over on itself card 16 may be removed from section pocket 11 through opening 18 for being personally signed and reinserted. The plastic package 10 may be manufactured from plastic tubing with top opening 18 formed with cut off of front 14 material thereabove. The tubular plastic material forming package 10 is cut off from the tubular plastic material at the bottom 19 and then heat sealed there across closing the bottom and provided a heat formed border edge 20 around the periphery of the package. A heat formed fold scored crease 21 is also formed in top tab extension 22 for fold over with package top openings 23 and 24 aligned for mounting of the package 10 on an arm of a merchandise mounting rack. The upper portion 25 of tab extension 22 is narrowed to lesser width to facilitate fold over insertion into the top opening 18 and is provided with an imprint area 26 for such as a trademark and company name. The scene and verse coordinated coin 17 and card 16 packaged by matched pairs are compact and flat lending themselves to compact mounting and easy viewing on a display rack, and also to easy stocking and display for selection from boxes and display shelves.

Figure 2:
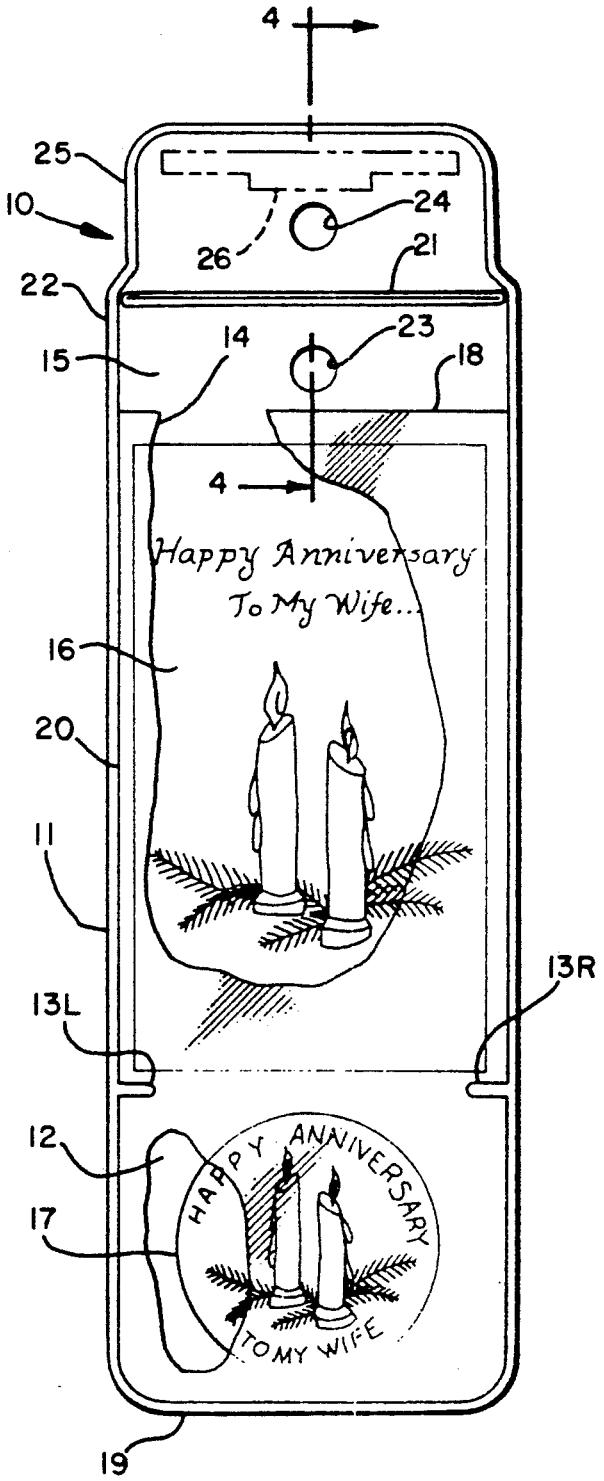
FIG. 2, a first side elevation view of the single entry two pocket section transparent package with part of each overlying pocket cut away for detail purposes and showing a common scene on the card and the coin.
Figure 3:
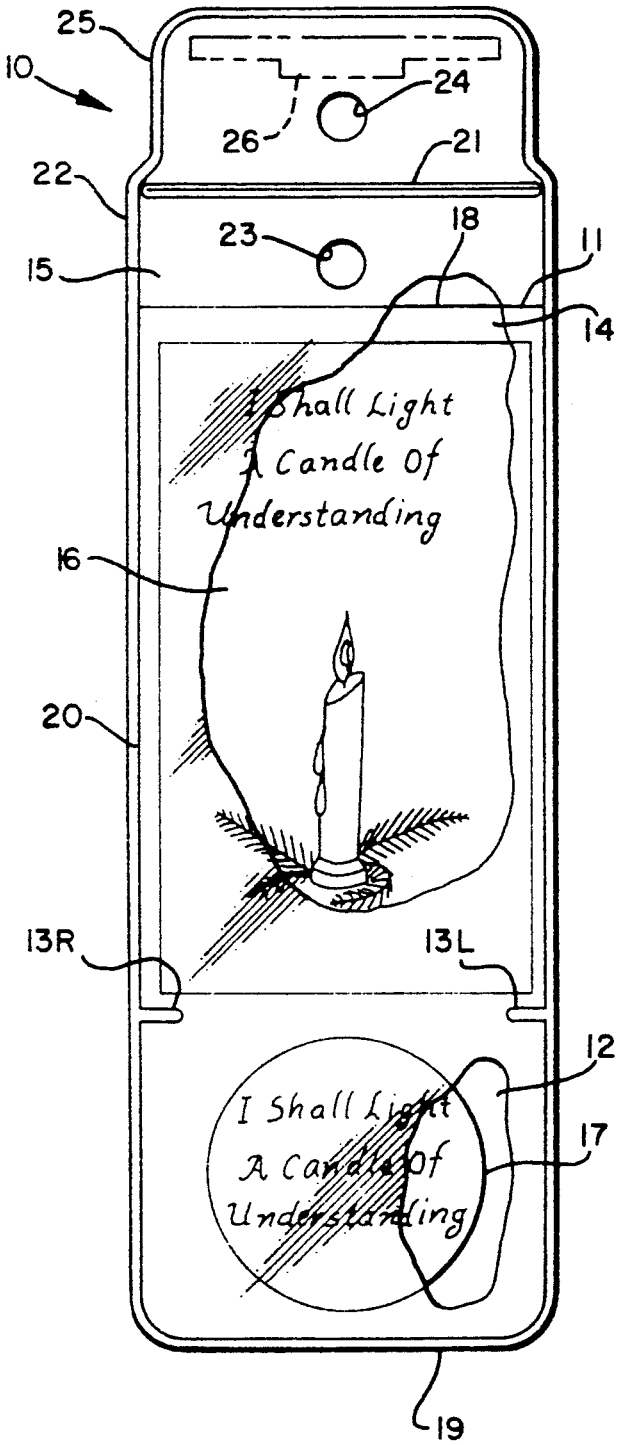
FIG. 3, a reverse side elevation view of the package again with part of the pocket sections cut away and illustrating that both the card and coin have a common theme saying printed thereon.
Figure 4:
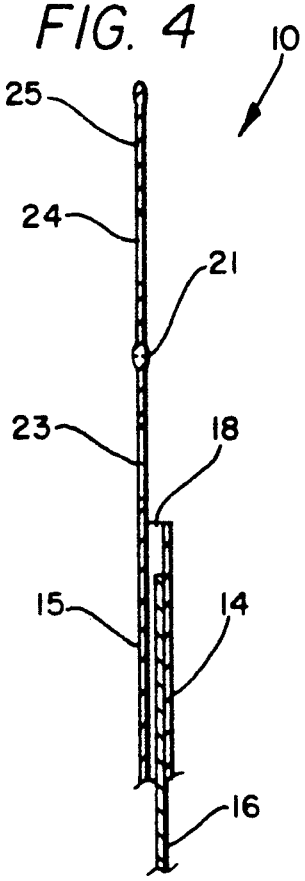
FIG. 4, a partial broken away and sectioned view taken along line 4—4 of FIG. 3 showing package top single entry and flap detail; and, FIG. 5, a partial broken away and sectioned view like FIG. 4 with the flap folded over and with the flap end inserted into the package top single entry opening.
Figure 5:
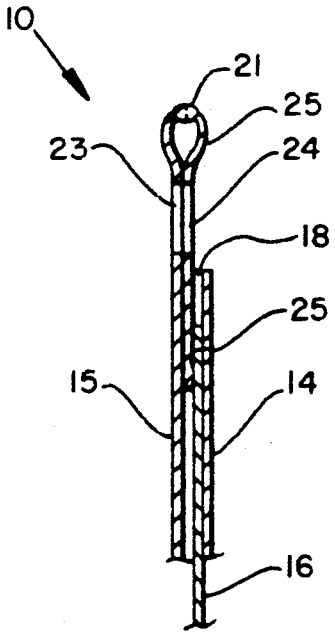

The forward face of the scene and verse coordinated coin 17 (or medallion) and card 16 packaged together in a two pocket sectioned 11 and 12 transparent plastic package 10, as shown in FIG. 2, show the same artistic scene 24 of burning candles with fern branches as an illustration of common artistic scene between the card 16 and the coin 17 of a coordinated pair in the package 10. On the back side of the card 16 and the coin 17 as shown in FIG. 3 both the card and the coin are shown to have the same verse "I Shall Light A Candle Of Understanding". While shown in this abbreviated form in FIG. 3, on an actual card and coin the verse reads "I Shall Light A Candle Of Understanding In Thine Heart Which Shall Not Be Put Out". In a matched pair card and coin with the valentine motif on the front side of the card and the coin had a matching cupid overlapping a heart and on the other side of each a verse "You are the blossom and my rose ... Please be my Valentine, The One Whom The Angels Chose".

Whereas this invention has been described with respect to several embodiments thereof, it should be realized that various changes may be made without departing from the essential contributions to the art made by the teachings hereof.

I claim:

1. A transparent package for a card and coin pair comprising: a two pocket section interconnected transparent plastic package with an upper elongate rectangular card receiving pocket section; a lower coin receiving pocket section aligned with and below said card receiving section; and passageway means sized to permit passage of said coin from said card receiving pocket section to said lower coin receiving pocket section; wherein said package has a front side and a back side, and opposite side edges; transverse inwardly directed from opposite left and right package side edges, plastic weldment extensions having inner ends spaced from each other; and said passageway means is an opening defined by said package front and back sides and the inner ends of said plastic extensions; said aligned upper elongate rectangular card receiving pocket section and said lower pocket receiving section are substantially the same width between said package opposite side edges; said passageway means opening space between the inner ends of said plastic weldment extensions is less than the side edge to edge width of said card; and with downward movement of said card limited in said upper elongate rectangular card receiving pocket section by card bottom edge contact with said plastic weldment extensions; said upper elongate rectangular card receiving pocket section is larger in planar area than said lower coin receiving section; said package is provided with a single exterior to interior opening for both said upper elongate rectangular card receiving pocket section and said lower coin receiving pocket section; said single exterior to interior opening is formed at the top of said upper elongate rectangular card receiving pocket section and below the top of the package front side; said plastic package is provided with a heat formed border edge extended around the periphery of the package; said lower coin receiving pocket section is seal closed at the bottom by said heat seal formed border edge; and including a tab extension of the back side of said package extended upward above said single exterior to interior opening; a heat formed transverse side to side fold scored crease is formed in said top tab extension; and two openings one above and one below said scored crease are provided in said top tab extension positioned to be in alignment when said top tab extension is folded down about said fold score crease.

2. The transparent package for a card and coin pair of claim 1, wherein the upper tab portion of said top tab extension is narrowed to lesser width beyond said fold scored crease to facilitate fold over insertion into said single exterior to interior opening.

3. A transparent package for a card and coin pair comprising: a two pocket section interconnected transparent plastic package with an upper elongate rectangular card receiving pocket section; a lower coin receiving pocket section aligned with and below said card receiving section; and passageway means sized to permit passage of said coin from said card receiving pocket section to said lower coin receiving pocket section; wherein said package has a front side and a back side, and opposite side edges; transverse inwardly directed from opposite left and right package side edges, plastic weldment extensions having inner ends spaced from each other; and said passageway means is an opening defined by said package front and back sides and the inner ends of said plastic extensions; said aligned upper elongate rectangular card receiving pocket section and said lower pocket receiving section are substantially the same width between said package opposite side edges; said package is provided with a single exterior to interior opening for both said upper elongate rectangular card receiving packet section and said lower coin receiving pocket section; said single exterior to interior opening is formed at the top of said upper elongate rectangular card receiving pocket section and below the top of the package front side; said plastic package is provided with a hat formed border edge extended around the periphery of the package; said lower coin receiving pocket section is seal closed at the bottom by said heat formed border edge; including a top tab extension of the back side of said package extended upward above said single exterior to interior opening; a heat formed transverse side to side fold scored crease is formed in said top tab extension; and wherein two openings one above and one below said scored crease are provided in said top tab extension positioned to be in alignment when said top tab extension is folded down about said folded crease; and wherein the upper portion of said top tab extension is narrowed to lesser width beyond said fold scored crease to facilitate fold over insertion into said single exterior to interior opening.

* * * * *